US005361438A

United States Patent [19]

Parati

[11] Patent Number: 5,361,438

[45] Date of Patent: Nov. 8, 1994

[54] PROCESS FOR THE INDIGO DYEING OF YARNS IN SKEINS

[75] Inventor: Agostino Parati, Brembate Sopra, Italy

[73] Assignee: Leglertex S.p.A.

[21] Appl. No.: 91,212

[22] Filed: Jul. 13, 1993

[30] Foreign Application Priority Data

Jul. 14, 1992 [IT] Italy ..... NI92A001708

[51] Int. Cl.[5] ..... D06B 3/09

[52] U.S. Cl. ..... 8/149.1; 8/151.2; 8/155.2; 68/22 R; 68/161; 68/175; 68/181 R

[58] Field of Search ..... 8/653, 151.2, 155.2, 8/149.1; 68/160–169, 175, 176, 181 R, 188

[56] References Cited

U.S. PATENT DOCUMENTS

| | | | |
|---|---|---|---|
| 668,694 | 2/1901 | Steenberghe | 68/161 |
| 1,417,825 | 5/1922 | Halter | 68/160 |
| 3,512,193 | 5/1970 | Kronsbein | 68/188 X |
| 4,123,921 | 11/1978 | Eakes | 68/22 R |

FOREIGN PATENT DOCUMENTS

| | | | |
|---|---|---|---|
| 1460401 | 1/1969 | Germany . | |
| 12834 | of 1913 | United Kingdom | 68/162 |
| 2140834 | 12/1984 | United Kingdom . | |

*Primary Examiner*—Philip R. Coe

*Attorney, Agent, or Firm*—Dressler, Goldsmith, Shore & Milnamow, Ltd.

[57] ABSTRACT

Process for the indigo dyeing of yarns in skeins having the peculiarity that it consists in placing a skein of yarn on at least two spaced rollers, in at least partially impregnating the skein in an indigo dyeing bath drawn continuously from a main indigo dyeing bath of a plant for the continuous dyeing of yarns in ropes or bands, in exposing the impregnated part to air for its oxidation, in alternately repeating impregnation and oxidation for a preset number of times which is a function of the color intensity to be obtained, in washing the skein to remove the residue of dye which has not been fixed on the fiber and in drying the skein.

5 Claims, 2 Drawing Sheets

PROCESS FOR THE INDIGO DYEING OF YARNS IN SKEINS

BACKGROUND OF THE INVENTION

The present invention relates to a process for the indigo dyeing of yarns in skeins or hanks.

As is known, the indigo dyeing of yarns is generally performed by means of so-called open width dyeing plants and so-called rope yarn plants.

In practice, open width plants use reels of yarn on which a large number of yarns, generally 350 to 400, is arranged; the yarns are arranged side by side and are passed in succession through the dyeing baths and rewound at the opposite end on reels in which the yarns are again arranged side by side.

In rope dyeing plants, dyeing is performed on a series of so-called ropes; each rope is constituted by a large number of yarns, generally 350 to 400, which are arranged side by side so as to define in practice a rope; said series is dyed by passing it in succession in a certain number of dyeing vats and, after the drying step, is placed in containers (one container per rope); the containers are then subjected to the separation of the yarns in order to arrange said yarns on reels (one container per reel) in which the yarns are arranged side by side.

This type of dyeing, which produces reels with a large number of yarns arranged side by side, is certainly useful if the weaving of fabrics is performed; in such weaving it can be useful to have the various yarns arranged side by side and wound on the same reel.

However, this arrangement does not allow to use the yarns in knitting machines, since it is necessary to have the yarn available on a spool.

Attempts made so far to dye the yarn arranged in skeins have not yielded satisfactory results, since the bath which is used for dyeing in skeins undergoes rapid degradation and change of characteristics, so that the dyeing does not have uniformity characteristics on the yarn.

Other known solutions, which provide for execution during the reeling of the yarn in ropes, by means of the separation of the yarns into groups of yarns which can then be subjected to a subsequent spooling step, are considerably complicated, since they require a long series of operations.

SUMMARY OF THE INVENTION

The aim of the invention is indeed to solve the above described problems by providing a process for the indigo dyeing of yarns in hanks or skeins which allows to perform dyeing of the yarn directly while it is arranged in skeins, without however being subject to the variations typical of the dyeing bath, which have led to unsatisfactory results with conventional methods.

Within the scope of the above aim, a particular object of the invention is to provide a process for the indigo dyeing of yarns in skeins which is particularly suitable for the obtainment of dyed yarns to be used in knitting, since passage from the single skein to the spool is extremely practical and easy.

Another object of the present invention is to provide a process which, by virtue of its peculiar characteristics of execution, is capable of giving the greatest assurances of reliability and safety in use.

Not least object of the present invention is to provide a process which can be obtained with a succession of easy steps, at least partially using conventional indigo dyeing elements.

This aim, these objects and others which will become apparent hereinafter are achieved by a process for the indigo dyeing of yarns in skeins, according to the invention, characterized in that it consists in placing a skein of yarn on at least two spaced rollers, in at least partially impregnating said skein in an indigo dyeing bath drawn continuously from a main indigo dyeing bath of a plant for the continuous dyeing of yarns in ropes or bands, in exposing the impregnated part to air for its oxidation, in alternately repeating impregnation and oxidation for a preset number of times which is a function of the color intensity to be obtained, in washing the skein to remove the residue of dye which has not been fixed on the fiber and in drying the skein.

BRIEF DESCRIPTION OF THE DRAWINGS

Further characteristics and advantages will become apparent from the description of a preferred but not exclusive embodiment of a process for the indigo dyeing of yarns in skeins, illustrated only by way of nonlimitative example with the aid of the accompanying drawings, wherein.

DESCRIPTION OF THE PREFERRED EMBODIMENTS

Figure 1:
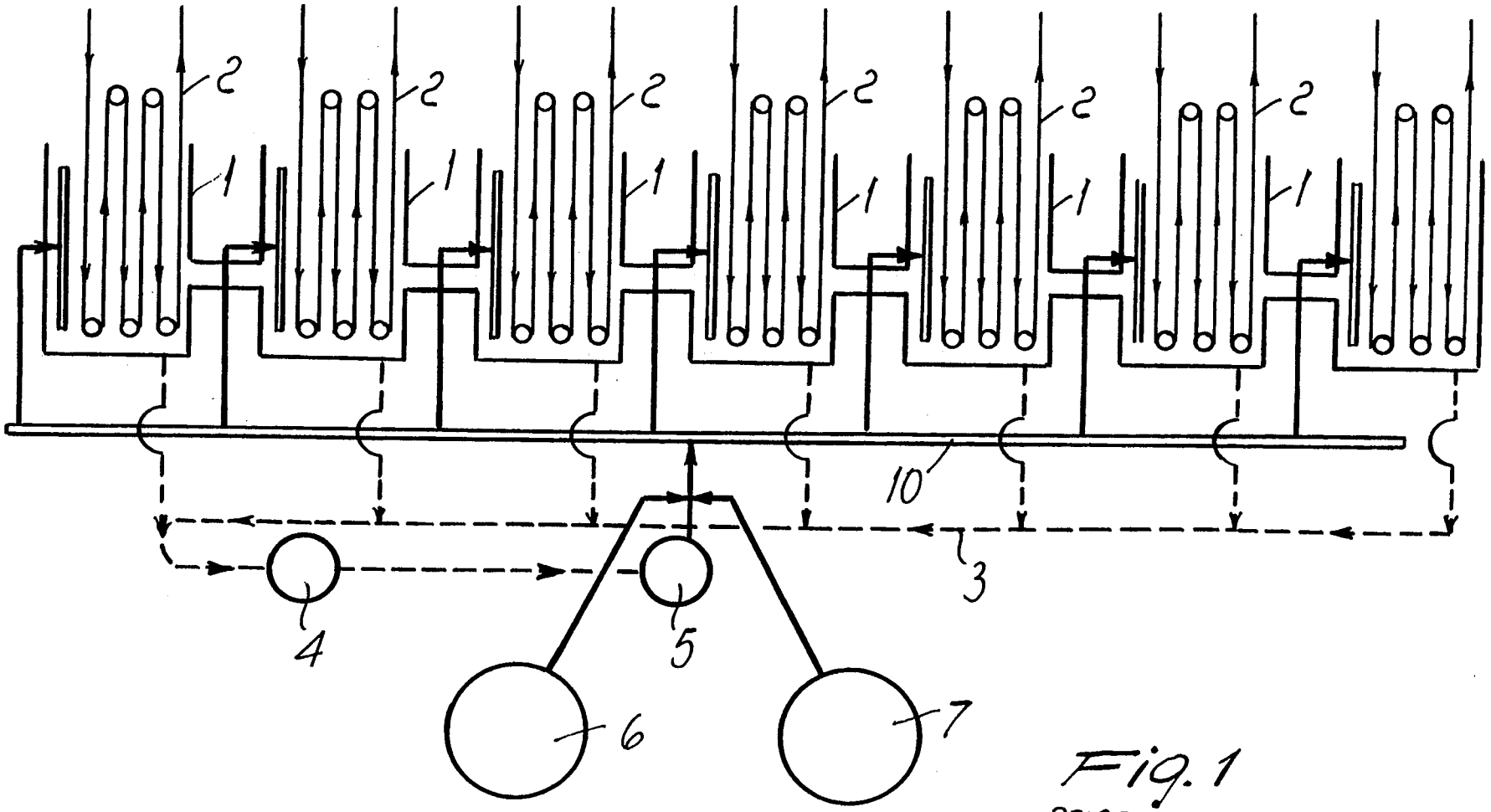
Fig. 1 PRIOR ART
FIG. 1 is a schematic view of a plant for the continuous indigo dyeing of yarns in ropes or bands.
Figure 2:
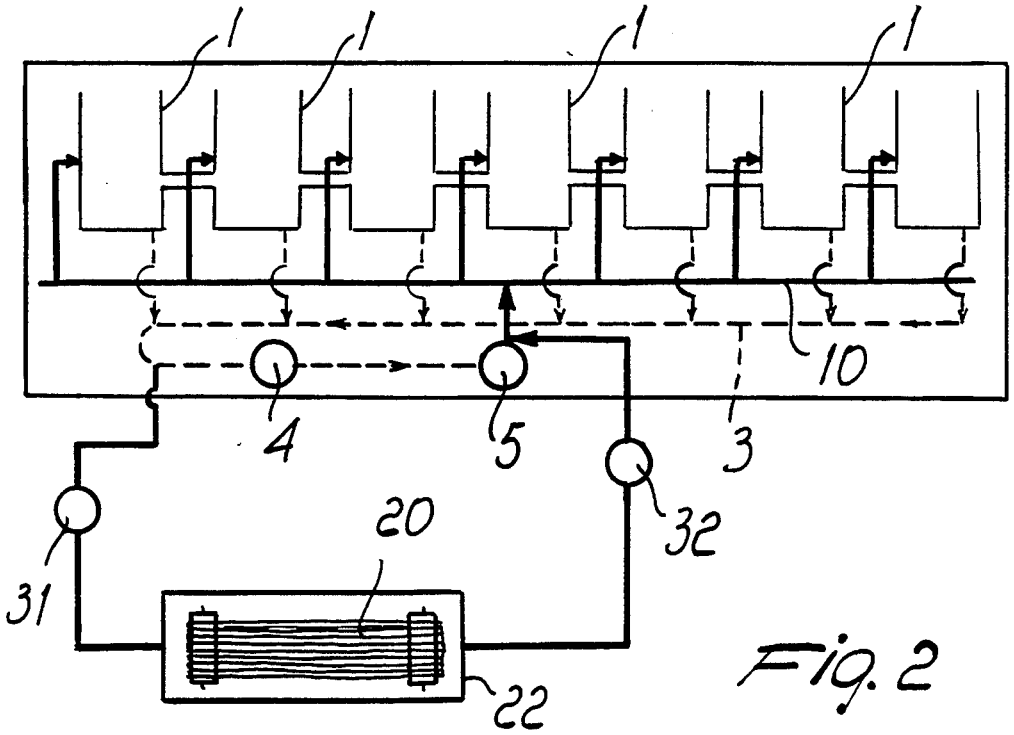
FIG. 2 is a schematic view of the plant connected to a unit for the indigo dyeing of yarns in skeins.
Figure 3:
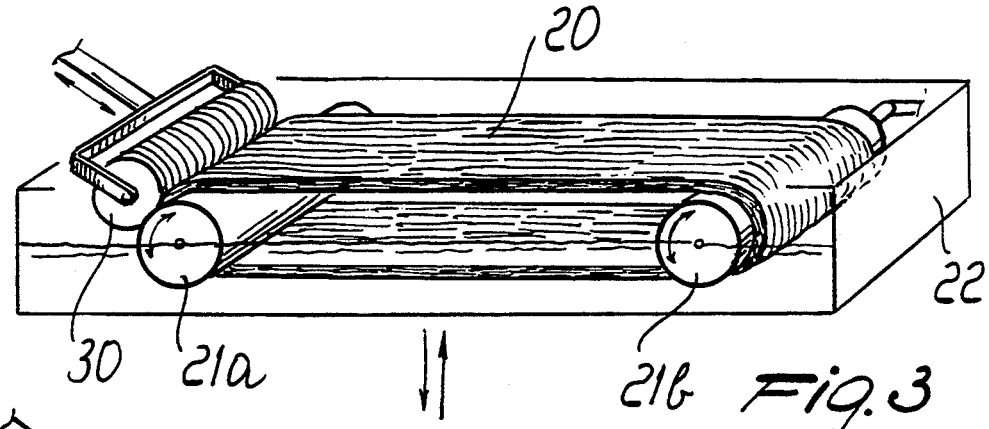
FIG. 3 is a schematic perspective view of the unit for the dyeing of the yarn in skeins.
Figure 4:
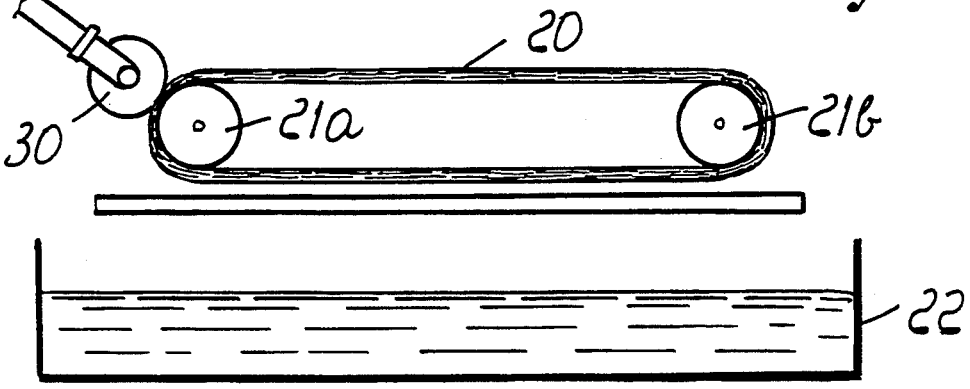
FIG. 4 is a schematic front elevational view of the unit for the dyeing of yarns in skeins, during the washing step.

With reference to the above figures, the conventional plant for the indigo dyeing of yarns in ropes or bands has a plurality of vats 1, generally six to eight, which have a capacity of approximately 3,000 liters each.

The yarn, designated by the reference numeral 2, is subjected in succession, in a per se known manner, to impregnation steps which are followed by oxidation steps which alternate continuously for a number of times which is equal to the number of vats in use.

The cycles related to dyeing provide for the feeding of the dye intensification baths, the homogenation of the dyeing bath and the absorption of the dyeing bath into the yarn.

Essentially, the intensification baths provide for the feeding of a first bath, known as main bath, which contains water, indigo, sulphinate and soda, and a second bath, known as reduction bath, which contains only water, sulphinate and soda.

Essentially, one liter of the intensification baths is fed for every kilogram of yarn which enters the machine.

In order to keep the bath feeds constant in any case, it is indispensable to operate by excess, allowing the tapping of the bath in order to keep its homogenation under control.

In order to obtain the homogenation of the bath as shown in FIG. 1, each vat is connected, at its bottom, to a return manifold 3 which, by means of a filter 4, is connected to a delivery pump 5 after which the feeds 6 and 7 merge; said feeds are constituted by said main bath and by the reduction bath; the bath, with its associated replenishments, is fed into a delivery duct 10 which is connected to the inside of the various vats 1, which are mutually interconnected so as to define in practice a communicating vessel.

The homogenation of the bath is obtained in this manner; said homogenation is also increased by the movement of the fabric, which is subjected to continuous ascending and descending passes which keep the bath of each individual vat in motion.

As previously mentioned, the feeds of the intensification baths are performed according to the amount of yarn to be dyed and according to the required color; all of the above is calculated in kg/h as regards the yarn, taking into account the speed of the dyeing line.

It should be stressed that the dosage of the feeds of the main bath and of the reduction bath is performed immediately after the delivery of the circulation pump, and this allows correct distribution in each individual vat, avoiding the forming of different situations of chemical equilibrium in the various regions of the dyeing bath.

The bath cannot be prepared beforehand, since it needs the intensification feeds, and the dyeing bath or main bath maintains, for the entire duration of the operation of the machine, its own distinct composition of soda, sulphinate and indigo, also by virtue of all the active recirculations.

When the machine stops, the feeds and the recirculations also stop, and the composition of the dyeing bath rapidly changes, mainly in its sulphinate component and also, to a lesser extent, in its soda component.

Due to these variations, it has been observed that the skein dyeing tested so far was unable to provide satisfactory results since it was not possible to keep the parameters constant and consequently obtain uniformity in the dyeing of the skein.

The invention has solved the problem by providing a process in which a skein dyeing unit is arranged and is in practice connected in parallel to a main indigo dyeing bath which arrives from a conventional plant for the continuous dyeing of yarns in ropes or bands.

In practical execution, the skein, designated by the reference numeral 20, is applied on two spaced rollers 21*a* and 21*b* which can be moved mutually closer so as to allow the application of the skein.

The rollers are arranged at a tray 22 in which the dyeing bath is fed; said bath is drawn from the main bath of the continuous plant, as schematically shown in FIG. 1.

The dyeing bath for the dyeing unit for skein is fed continuously, so that a stabilized bath, with the correct parameters for the type of dyeing to be performed, is always available; this stability is ensured by the fact that the main bath is controlled as mentioned above.

Once the skein has been applied on the rollers, said skein is immersed in the skein dyeing bath, in practice by lifting the tray 22, so that the bath arrives at the axes of the rollers, so that half of the skein remains immersed.

One of the rollers, and specifically the roller designated by the reference numeral 21*a*, is a drive roller; once it is made to rotate, it creates a continuous movement of the skein, impregnating it, so that the skein is partially immersed in the dyeing bath and is then exposed to the air to oxidize the dye; the cycle is repeated for a preset number of times, according to the shade of color to be obtained.

Advantageously, the roller is rotated for a certain period of time, so as to obtain a movement of the skein in the bath which is in counter-current, and rotation is reversed for alternating periods of time so as to have parallel-flow immersion; this allows to keep a constantly uniform distribution in the bath, avoiding the forming of preferential regions of flow of dyeing liquid.

According to a non-limitative embodiment, a skein with a circumference of 1940 mm, a weight of 250 g, a length of yarn in the skein of approximately 6800 m and a skein width on the rollers of 200 mm is prepared using a 16-count yarn.

Three passes in counter-current with respect to the dyeing bath, alternated with two parallel-flow passes, are advantageously performed.

In practice, each pass, which lasts approximately one minute, is composed of 30 seconds of impregnation alternated with 30 seconds of oxidation.

Once alternated impregnation and oxidation have been performed, the skein is passed in air for approximately 1 minute so as to complete oxidation.

After these steps, the skein is subjected to conventional washing in warm and cold water to remove the residue of dye which has not fixed on the fiber, and then said skein is removed from the rollers and put to dry.

To the above it should also be added that a squeezer roller, designated by the reference numeral 30, is provided at the drive roller and has the purpose of removing the excess liquid from the yarn.

The dyeing bath which is used in the group of yarns arranged in a skein is drawn, as mentioned, from the main bath by means of the pump 31 and after the dyeing of the group arranged in a skein it is returned to the main bath by means of the pump 32, so as to always use a dyeing liquid which has uniform and stable characteristics.

It is considerably important to stress the fact that uniform skein dyeing is obtained since, by using in practice the main bath of a plant for continuous dyeing in bands or ropes, a bath which allows to maintain a correct and time-invariant chemical equilibrium is always available, preventing the occurrence of problems in color intensity, friction strength and risk of excessive penetration of dye into the fiber.

In practice, therefore, dyeing in skeins is possible since a closed circuit for the recirculation of the dyeing bath is provided; said recirculation occurs over a main bath which, in addition to being constituted by a large quantity, is always assuredly controlled and stabilized in a conventional manner.

From what has been described above, it can thus be seen that the invention achieves aim and objects, and in particular, the fact is stressed that skein dyeing with remarkable characteristics of stability and color uniformity is obtained, simplifying all the subsequent steps for the rewinding of the yarns, since a dyed yarn in skeins is directly available.

The invention thus conceived is susceptible to numerous modifications and variations, all of which are within the scope of the inventive concept.

All the details may furthermore be replaced with other technically equivalent elements.

What is claimed:

1. Process for the indigo dyeing of yarns in hanks or skeins, comprising the steps of:

placing a skein of yarn on at least two spaced rollers;

at least partially impregnating said skein in an indigo dyeing bath drawn continuously from a main indigo dyeing bath of a plant for the continuous dyeing of yarn in ropes or bands;

exposing said skein in air for oxidation;

alternately repeating the impregnation and oxidation steps for a preset number of times which is a function of the color intensity to be obtained;

washing the skein to remove the residue of dye which has not been fixed to the yarn of said skein; and drying said skein.

2. Process according to claim 1, wherein at least one of said rollers is motorized to perform a translatory motion of said skein inside the skein dyeing bath and substantially one half of said skeins extension is immersed in said bath.

3. Process according to claim 2, wherein the skein is squeezed by means of a squeezer roller provided at said at least one motorized roller.

4. Process according to claim 1, wherein the skein dyeing bath is placed in a tray and is continuously recirculated with said main bath, said tray being located below said rollers.

5. Process according to claim 1, wherein said skein is alternately subjected to impregnation cycles with movement in counter-current with respect to the bath and to impregnation cycles with parallel flow movement with respect to the skein dyeing bath.

* * * * *